United States Patent [19]

Hart

[11] 3,972,149

[45] Aug. 3, 1976

[54] END BLASTER FOR PIPES

[75] Inventor: Robert J. Hart, Tulsa, Okla.

[73] Assignee: Commercial Resins Company, Tulsa, Okla.

[22] Filed: Mar. 3, 1975

[21] Appl. No.: 554,510

[52] U.S. Cl. ..... 51/8 R; 51/8 H; 51/15 H

[51] Int. Cl.[2] ..... B24C 3/24

[58] Field of Search ..... 51/8 R, 8 HT, 15 H, 51/241 S, 241 B, 319–321

[56] References Cited

UNITED STATES PATENTS

| | | | |
|---|---|---|---|
| 2,479,299 | 8/1949 | Biggs | 51/8 HI |
| 2,869,293 | 1/1959 | Howard | 51/241 B |
| 3,352,062 | 11/1967 | Conover | 51/8 R |
| 3,426,563 | 2/1969 | Burney | 51/319 X |
| 3,854,899 | 12/1974 | Germain | 51/319 |

*Primary Examiner*—Al Lawrence Smith
*Assistant Examiner*—Gary L. Smith
*Attorney, Agent, or Firm*—William S. Dorman

[57] ABSTRACT

A device for abrasive-blast cleaning of the end of a pipe prior to welding, comprised of a disc engagable with the pipe end to be blast-cleaned and held in position by adjustable bolts and rams, a positioning spider used to position the disc with respect to the end of the pipe, a blasting head affixed to the positioning spider and movable circumferentially over the end of the pipe, means for supplying abrasive material under pressure to the blasting head and drive means for rotating the positioning spider and blasting head.

7 Claims, 4 Drawing Figures

END BLASTER FOR PIPES

BACKGROUND OF THE INVENTION

1. Field of the Invention

This invention relates to an apparatus for cleaning the end of a pipe prior to welding; more particularly, the device of the present invention relates to a mechanical abrasive-blast machine of the type having a blasting head receiving the workpiece therein and having abrasive material supplied under pressure to said blasting head, and is so designed that the abrasive material can be removed from the blast head by suction.

2. Description of the Prior Art

The abrasive blast cleaning of the end of pipes prior to welding has generally been a manual operation. In Conover, U.S. Pat. No. 3,352,062 (1965), a sand blast device was disclosed wherein a blasting chamber completely encircled the end of a pipe to be blast-cleaned. A plurality of ports were provided for the injection of air which was to pick up previously introduced abrasive material and impinge the abrasive material against the pipe, thereby cleaning it. This system would seem to prove deficient in several respects, the first being chance abrasion of the entire surface to be welded, because of the limited number of injection ports. Secondly, Conover anticipates that his disclosure may be deficient and might require the device (which is normally non-rotatable) to be rotated manually around the pipe in order to insure the entire area will be efficiently blast-cleaned by the abrasive material. The current invention provides for a smaller blasting chamber which has a greater and localized blasting effect with mechanical means for rotating the blasting chamber with respect to the entire circumferential edge of the pipe to be cleaned.

SUMMARY OF THE INVENTION

The present invention involves a device for abrasive-blast cleaning the end of a pipe prior to welding. The apparatus includes a disc engagable with the pipe end to be blast-cleaned. The inner face of the disc is provided with adjustable bolts and rams which engage the inner peripheral surface of the pipe to hold the disc firmly within the pipe. A positioning spider is rotatably mounted on the outer face of the disc and has rollers at the ends of the arms of the spider to engage the outer edge of the pipe for properly positioning the apparatus with respect to the end of the pipe. A blasting head is also mounted on the spider to receive a portion of the end of the pipe therein. The blasting head has means for supplying abrasive material thereto under pressure. The blasting head is provided with various seals around the blasting chamber therein to minimize the loss of abrasive materal. Means are provided for rotating the spider so as to rotate the blasting head around the entire circumference of the end of the pipe.

DESCRIPTION OF THE PREFERRED EMBODIMENT

Figure 1:
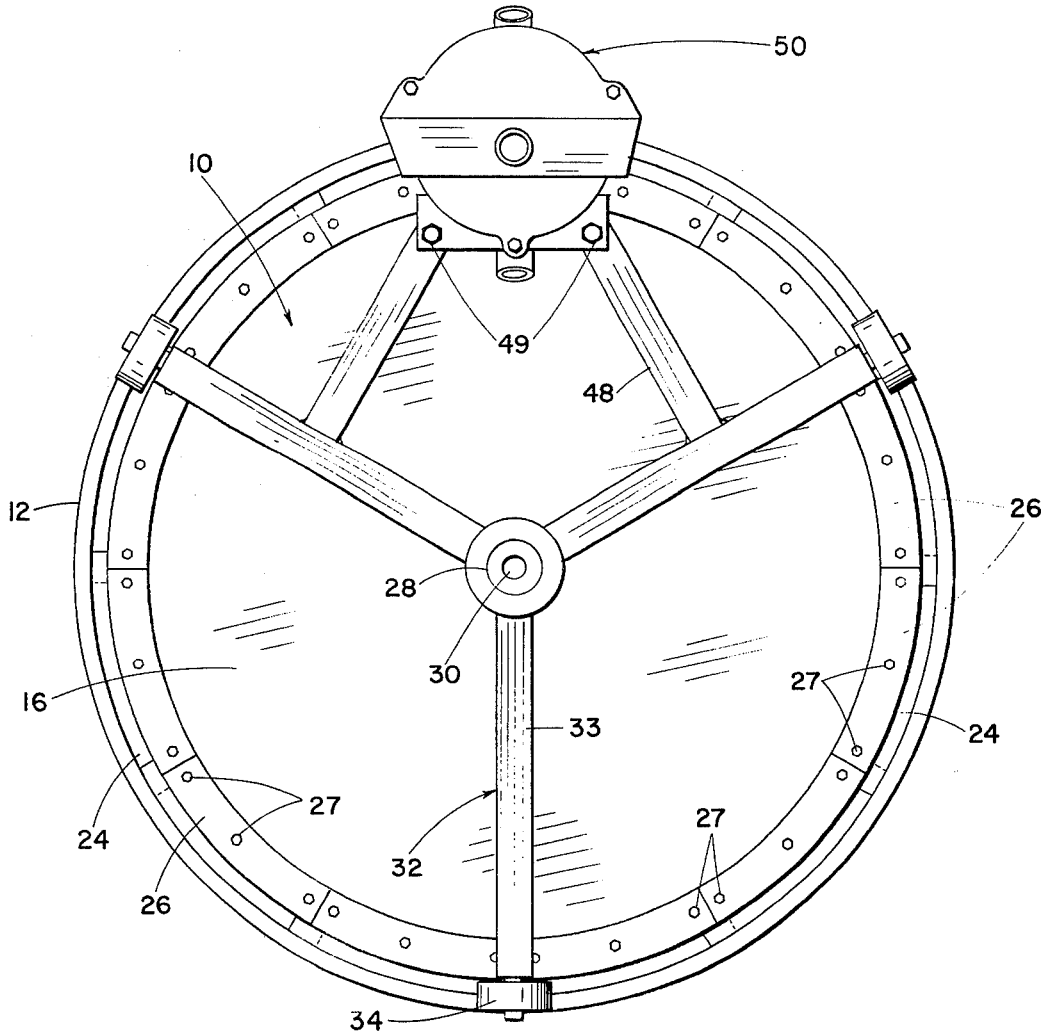
FIG. 1 is a front elevational view of the invention, as seen from outside the pipe to be cleaned.
Figure 2:
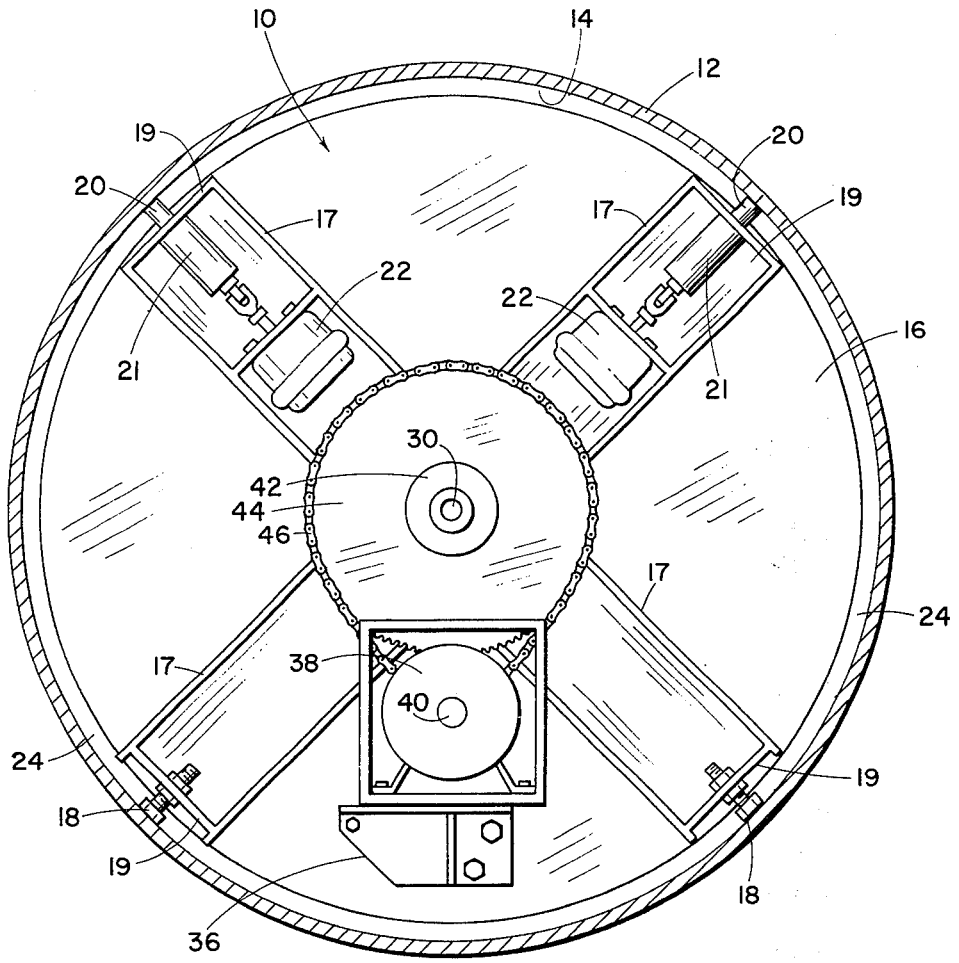
FIG. 2 is a rear elevational view of the invention, as seen from the interior of the pipe.

Referring to the figures in detail, FIGS. 1 and 2 show an end blaster 10 located within the interior 14 of a pipe 12. A disc 16 provides a basis for a locating means for the unit 10. A plurality of box-like braces 17 are affixed to the disc 16 on the side of the disc which would be received within the pipe 12. The preferred embodiment shown in the figures relates the use of four of the box-like structures 17; however, it should be realized that a plurality of at least three brackets 17 are required to effectuate the greatest degree of flexibility for locating the disc 16. Adjustable locating means are provided by the use of radially adjustable, circumferentially acting bolts 18, and reciprocating rams 20. The bolts 18 are threadedly adjustable through the outer ends 19 of the box-like brackets 17. The reciprocating rams 20 are slidably received within sleeves 21 affixed to the outer end 19 of the brackets 17. A jack (or power means) 22 connected to the ram 20 activates the ram 20 radially to and from the interior 14 of the pipe 12.

A gasket 24 provides a seal between the disc 16 and the interior of the pipe 14. The gasket 24 is mounted to the disc 16 by a plurality of gasket retainers 26 which are secured to the disc by a plurality of bolts 27.

A hub 28 is received upon a bearing (not shown) which is centrally positioned upon the disc 16. The hub 28 has an axial hole 30 therethrough. A spider 32 is affixed to the hub 28. Each arm 33 of the spider 32 has a roller 34 received upon the outer end thereof. The roller 34 engages the circumferential edge of the pipe 12. A motor bracket 36 is affixed to the interior side of the disc 16 (see FIG. 2). A motor 38 with a shaft 40 therethrough is secured to the motor bracket 36. A first sprocket (not shown) is received upon the shaft 40 of the motor 38. A hub 42 mounted on the interior side of the disc 16 is rotatably connected through the disc 16 to the hub 28 and has a second sprocket 44 received thereupon. A chain 46 connects the first sprocket (not shown) with the second sprocket 44. A pair of support arms 48 are affixed to the spider 32. A blaster head 50 is secured to the support arms 48 by bolts 49.

Figure 3:
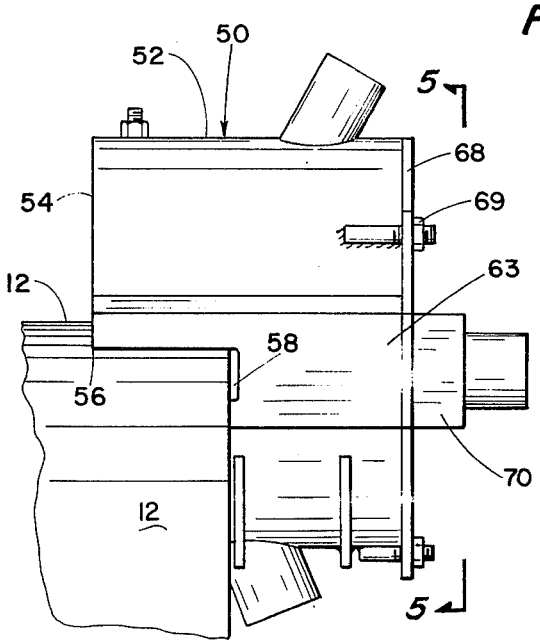
FIG. 3 is a side view of the blaster head.
Figure 4:
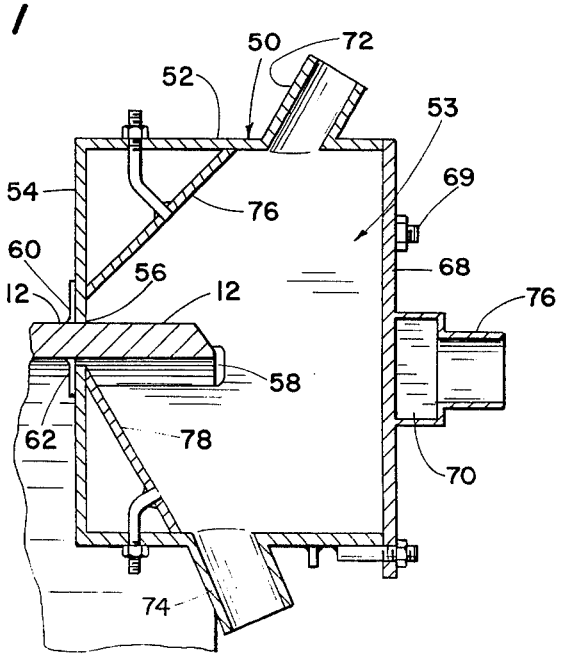
FIG. 4 is a cross-sectional view along line 4—4 of FIG. 3.
Figure 5:
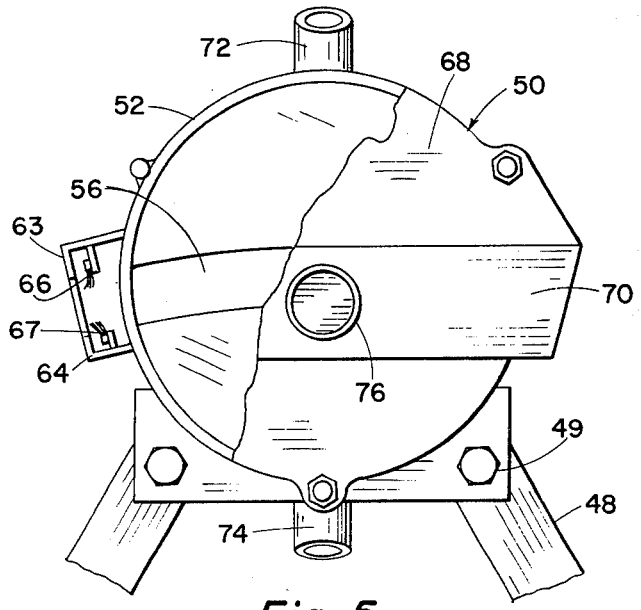
FIG. 5 is a view of the blaster head with a portion of the cover removed to show internal details.

Referring now to FIGS. 3, 4 and 5, the blaster head 50 has a substantially circular body 52 and an integral vertical face 54 attached thereto, thereby forming a blasting chamber 53. The face 54 has an arcuate opening 56 therein, and the body 52 has a slot 58 at each end of the arcuate opening 56. The face 54 has seals 60 and 62 (of rubber or plastic) along the upper and lower edges of the slot 58. Anterior to the body 52 at the ends of the arcuate opening 56 are collector boxes 63 affixed to the body 52. Each collector box 63 has an opening 64 coextensive with the slot 58. The pipe 12 is received through the arcuate opening 56 and received within the blasting chamber 53, entering through slots 58 of the body and 64 of the end chambers. The pipe 12 is grasped by seals 60 and 62 about the arcuate opening 56 of the face 54, and by rim seals 66 and 67 of the end chambers thereby minimizing the escape of abrasive material from the blaster head 50.

A back cover plate 68 is fastened to the body 52 by conventional bolt means 69. A collector channel 70 is affixed to the exterior of the back cover plate 68. The collector channel 70 is in communication at its ends with the collector boxes 63 of the head 50.

Abrasive material is introduced into the blasting chamber 53 of the blaster head 50 through inclined nozzles 72 and 74. Interior baffles 76 and 78 direct the abrasive blast toward the pipe 12. The abrasive material, and its carrier, are exhausted through the exhaust port 76 of the collector channel 70.

The interior of the body 52, the interior of the back cover plate 68 and the baffles 76 and 78 are coated with abrasive resistant material, such as rubber, to minimize abrasive erosion.

OPERATION

In typical operation, bolts 18 would be extended radially to a distance typical of the radius of the interior 14 of a pipe 12. The disc 16 would be inserted within the interior 14 of the pipe 12. In the preferred embodiment, the rams 20 would be extended by jacks 22 of the type powered by compressed gas. With pressure applied to the jack 22 the ram 20 would be urged outward into contact with the interior of the pipe 14. Prior to energizing the jacks 22, the rollers 34 of the spider 32 would be brought into engagement with the circumferential edge of the pipe 12. By so positioning the rollers 34, the pipe 12 would be received within the blaster head 50. Service lines to the jacks 22 and motor 38 would pass through the hole 30. The jacks 22 would be energized forcing the rams 20 into engagement with the pipe 12. Power would be supplied to the motor 38. Shaft 40 would rotate, as would the first sprocket (not shown). The second sprocket 44, linked to the first sprocket by chain 46, would rotate hub 42 which would in turn rotate hub 28. Rotating the spider 32 would rotate the blaster head 50.

Abrasive material would be introduced under pressure through the inclined ports 72 and 74. Abrasive material would be retained within the blaster head 50 by the seals 60 and 62 affixed to the face 54, and by seals 66 and 67 of the end chambers. Abrasive material would collect in the end chambers 63. If sand, or other inexpensive abrasive material, were used as the abrading medium, it would be possible to exhaust the blasting chamber 53 directly to the atmosphere. If more costly, or polluting, abrading materials were used, the back cover plate 68 could be installed and an exhaust or suction line could be connected to the port 76.

Whereas the present invention has been described in particular relation to the drawings attached hereto, it should be understood that other and further modifications and embodiments, apart from those shown or suggested herein, could be made within the spirit and scope of this invention.

What is claimed is:

1. An end blaster for cleaning the end of a pipe comprising a locating means engagable with the interior of the pipe adjacent the end to be cleaned, said locating means having a substantially disc-shaped base, at least three circumferentially spaced and radially directed pipe-engaging elements mounted on said base and means for urging at least one of said pipe-engaging elements radially outwardly against the interior of said pipe, a movable positioning means rotatably mounted on said locating means, a blasting means mounted on said positioning means adjacent the end of said pipe so that, when said positioning means is rotated, said blasting means will move circumferentially over the end of said pipe, means for supplying abrasive material under pressure to said blasting means and drive means for rotating said positioning means.

2. An end blaster for pipes as set forth in claim 1 wherein at least one pipe-engaging element includes a radially adjustable locating bolt affixed to said disc at the periphery thereof.

3. An end blaster as set forth in claim 1 wherein said means for urging at least one of said pipe engaging elements is comprised of a reciprocating ram acting radially at the periphery of said disc, a jack mounted upon said disc, said jack urging said reciprocating ram outwardly into engagement with the interior of said pipe.

4. An end blaster for cleaning the end of a pipe comprising a locating means engagable with the interior of the pipe adjacent the end to be cleaned, a movable positioning means rotatably mounted on said locating means, a blasting means mounted on said positioning means adjacent the end of said pipe so that, when said positioning means is rotated, said blasting means will move circumferentially over the end of said pipe, means for supplying abrasive material under pressure to said blasting means and drive means for rotating said positioning means, and said blasting means being a substantially circular body with an integral front face affixed thereto, thereby forming a blasting chamber, said front face having an arcuate opening therein concentric with said hub, inner and outer edge seals about said arcuate opening, said body having slots therein at the ends of said arcuate opening, end chambers covering said slots and having internal rim seals therein, said end chambers being slotted whereby said pipe may be introduced within said body and end chambers, and grasped by said edge seals and said rim seals to minimize the escape of abrasive material, baffles mounted within said body for directing said abrasive material toward the pipe, inclined inlet ports for projecting abrasive material toward the edge of said pipe, a back cover plate secured to said body, a collector channel affixed to the outside of said cover plate, said collector channel being in communication with said end chambers, an exhaust port affixed to said collector channel whereby abrasive material introduced into said blaster head is exhausted, and the interior of said blasting chamber and said cover plate having an abrasion resisting material coated thereon, thereby minimizing metallic erosion.

5. An end blaster for cleaning the end of a pipe comprising a locating means engagable with the interior of the pipe adjacent the end to be cleaned, a movable positioning means rotatably mounted on said locating means, a blasting means mounted on said positioning means and receiving a portion of the end of said pipe therein so that, when said positioning means is rotated, said blasting means will move circumferentially over the end of said pipe, means for supplying abrasive material under pressure to said blasting means and drive means for rotating said positioning means, said locating means including a sealing means comprised of a circumferentially mounted gasket extending beyond the positioning means and engagable with the interior of said pipe, said gasket being mounted on said positioning means by a plurality of gasket retainers secured to said positioning means.

6. An end blaster for cleaning the end of a pipe comprising a locating means engagable with the interior of the pipe adjacent the end to be cleaned, a movable positioning means rotatably mounted on said locating means, a blasting means mounted on said positioning means and receiving a portion of the end of said pipe therein so that, when said positioning means is rotated, said blasting means will move circumferentially over the end of said pipe, means for supplying abrasive material under pressure to said blasting means and drive means for rotating said positioning means, said positioning means being comprised of a hub rotatably mounted one one side of said positioning means, a spider having arms connecting with said hub, the arms of said spider extending beyond the periphery of said pipe, a roller received upon each arm of said spider, said roller contacting the circumferential edge of said pipe, thereby positioning said spider in relation to said pipe thus permitting said locating means to be fixably related with the interior of said pipe.

7. An end blaster as set forth in claim 6 including a pair of support arms affixed to said positioning means, said blasting means secured to said support arms and received upon the circumferential edge of said pipe, a second hub connected through said positioning means to the first-mentioned hub, a sprocket received on said second hub, a motor mounted on the side opposite said one side of said positioning means and having a shaft thereon, a second sprocket attached to said shaft, a chain connecting said sprocket with said second sprocket for rotating said spider and said blasting means when said motor is activated.

* * * * *